US008628086B2

(12) United States Patent
Krenn et al.

(10) Patent No.: US 8,628,086 B2
(45) Date of Patent: Jan. 14, 2014

(54) SHUFFLING DEVICES INCLUDING ONE OR MORE SENSORS FOR DETECTING OPERATIONAL PARAMETERS AND RELATED METHODS

(75) Inventors: Peter Krenn, Neufeld (AT); Ernst Blaha, Tullnerbach (AT)

(73) Assignee: SHFL Entertainment, Inc., Las Vegas, NV (US)

( * ) Notice: Subject to any disclaimer, the term of this patent is extended or adjusted under 35 U.S.C. 154(b) by 0 days.

(21) Appl. No.: 13/411,922

(22) Filed: Mar. 5, 2012

(65) Prior Publication Data

US 2012/0161393 A1 Jun. 28, 2012

Related U.S. Application Data

(63) Continuation of application No. 10/940,420, filed on Sep. 14, 2004, now abandoned.

(51) Int. Cl.
*A63F 9/24* (2006.01)
*A63F 13/00* (2006.01)

(52) U.S. Cl.
USPC ..... 273/149 R; 463/12; 463/25; 463/29; 273/292

(58) Field of Classification Search
USPC ..... 463/12, 25, 29; 273/149 R, 292
See application file for complete search history.

(56) References Cited

U.S. PATENT DOCUMENTS 130,281 A 8/1872 Coughlin
793,489 A 6/1905 Williams
1,014,219 A 1/1912 Hall
1,850,114 A 6/1929 McCaddin
1,885,276 A 11/1932 McKay
1,955,926 A 4/1934 Matthaey (Continued)

FOREIGN PATENT DOCUMENTS

AU 50254/79 3/1980
JP 2008-246061 10/2008

(Continued)

OTHER PUBLICATIONS

CD Labeled "Shuffler Art". Attached to this 1449 is a spreadsheet having the names of the individual files within the CD. There is a self-executing function on the CD so that, upon entering the Spreadsheet Table of Contents (Index), individual items may be opened directly from the spreadsheet according to the title of the document (2003).

(Continued)

*Primary Examiner* — Dmitry Suhol
*Assistant Examiner* — Ryan Hsu
(74) *Attorney, Agent, or Firm* — TraskBritt

(57) ABSTRACT

A shuffling device for playing cards and method of shuffling cards is provided where a first group of cards is moved within the device to form a randomized second group of cards. The device comprises moving parts that assist in the movement of cards within the shuffling device; a processor in informational connection with the shuffling device; a sensor that detects at least one of speed, distance and force of at least one moving part and provides a signal to the processor regarding detection of at least one of speed, distance and force; and the processor containing a program that interprets the signal to detect significant variations in at least one of speed, distance and force of the moving part.

44 Claims, 8 Drawing Sheets

(56) References Cited

U.S. PATENT DOCUMENTS 2,001,220 A 5/1935 Smith
2,001,918 A 5/1935 Nevius
2,016,030 A 10/1935 Woodruff et al.
2,043,343 A 6/1936 Warner
2,065,824 A 12/1936 Plass
2,159,958 A 5/1939 Sachs
2,185,474 A 1/1940 Nott
2,543,522 A 2/1951 Cohen
2,588,582 A 3/1952 Sivertson
2,661,215 A 12/1953 Stevens
2,676,020 A 4/1954 Ogden
2,701,720 A 2/1955 Ogden
2,705,638 A 4/1955 Newcomb
2,711,319 A 6/1955 Morgan et al.
2,714,510 A 8/1955 Oppenlander et al.
2,727,747 A 12/1955 Semisch, Jr.
2,731,271 A 1/1956 Brown
2,747,877 A 5/1956 Howard
2,755,090 A 7/1956 Aldrich
2,757,005 A 7/1956 Nothaft
2,760,779 A 8/1956 Ogden et al.
2,770,459 A 11/1956 Wilson et al.
2,778,643 A 1/1957 Williams
2,778,644 A 1/1957 Stephenson
2,782,040 A 2/1957 Matter
2,790,641 A 4/1957 Adams
2,793,863 A 5/1957 Liebelt
2,815,214 A 12/1957 Hall
2,821,399 A 1/1958 Heinoo
2,937,739 A 5/1960 Levy
2,950,005 A 8/1960 MacDonald
3,067,885 A 12/1962 Kohler
3,107,096 A 10/1963 Osborn
3,131,935 A 5/1964 Grönneberg
3,147,978 A 9/1964 Sjöstrand
3,235,741 A 2/1966 Plaisance
3,305,237 A 2/1967 Granius
3,312,473 A 4/1967 Friedman et al.
3,588,116 A 6/1971 Miura
3,589,730 A 6/1971 Slay
3,595,388 A 7/1971 Castaldi
3,627,331 A 12/1971 Lyon, Jr.
3,666,270 A 5/1972 Mazur
3,690,670 A 9/1972 Cassady et al.
3,716,238 A 2/1973 Porter
3,897,954 A 8/1975 Erickson et al.
3,929,339 A 12/1975 Mattioli
3,944,230 A 3/1976 Fineman
3,949,219 A 4/1976 Crouse
3,968,364 A 7/1976 Miller
4,033,590 A 7/1977 Pic
4,159,581 A 7/1979 Lichtenberg
4,162,649 A 7/1979 Thornton
4,166,615 A 9/1979 Noguchi et al.
4,232,861 A 11/1980 Maul
4,280,690 A 7/1981 Hill
4,310,160 A 1/1982 Willette et al.
4,361,393 A 11/1982 Noto
4,368,972 A 1/1983 Naramore
4,374,309 A 2/1983 Walton
4,385,827 A 5/1983 Naramore
4,388,994 A 6/1983 Suda et al.
4,397,469 A 8/1983 Carter, III
4,421,312 A 12/1983 Delgado et al.
4,497,488 A 2/1985 Plevyak et al.
4,512,580 A 4/1985 Matviak
4,513,969 A 4/1985 Samsel, Jr.
4,515,367 A 5/1985 Howard
4,534,562 A 8/1985 Cuff et al.
4,566,782 A 1/1986 Britt et al.
4,586,712 A 5/1986 Lorber et al.
4,659,082 A 4/1987 Greenberg
4,662,637 A 5/1987 Pfeiffer
4,662,816 A 5/1987 Fabrig
4,667,959 A 5/1987 Pfeiffer et al.
4,741,524 A 5/1988 Bromage
4,750,743 A 6/1988 Nicoletti
4,759,448 A 7/1988 Kawabata
4,770,421 A 9/1988 Hoffman
4,807,884 A 2/1989 Breeding
4,822,050 A 4/1989 Normand et al.
4,832,342 A 5/1989 Plevyak et al.
4,876,000 A 10/1989 Mikhail
4,900,009 A 2/1990 Kitahara et al.
4,904,830 A 2/1990 Rizzuto
4,948,134 A 8/1990 Suttle et al.
4,951,950 A 8/1990 Normand et al.
4,969,648 A 11/1990 Hollinger et al.
5,000,453 A 3/1991 Stevens et al.
5,067,713 A 11/1991 Soules et al.
5,078,405 A 1/1992 Jones et al.
5,102,293 A 4/1992 Schneider
5,121,921 A 6/1992 Friedman et al.
5,154,429 A 10/1992 LeVasseur
5,199,710 A 4/1993 Lamle
5,240,140 A 8/1993 Huen
5,261,667 A 11/1993 Breeding
5,275,411 A 1/1994 Breeding
5,288,081 A 2/1994 Breeding
5,303,921 A 4/1994 Breeding
5,356,145 A 10/1994 Verschoor
5,374,061 A 12/1994 Albrecht
5,382,024 A 1/1995 Blaha
5,382,025 A 1/1995 Sklansky et al.
5,390,910 A 2/1995 Mandel et al.
5,431,399 A 7/1995 Kelley
5,437,462 A 8/1995 Breeding
5,445,377 A 8/1995 Steinbach
5,575,475 A 11/1996 Steinbach
5,584,483 A 12/1996 Sines et al.
5,586,936 A 12/1996 Bennett et al.
5,605,334 A 2/1997 McCrea, Jr.
5,669,816 A 9/1997 Garczynski et al.
5,676,372 A 10/1997 Sines et al.
5,681,039 A 10/1997 Miller
5,683,085 A 11/1997 Johnson et al.
5,690,324 A 11/1997 Otomo et al.
5,692,748 A 12/1997 Frisco et al.
5,695,189 A 12/1997 Breeding et al.
5,707,287 A 1/1998 McCrea, Jr.
5,718,427 A 2/1998 Cranford et al.
5,722,893 A 3/1998 Hill et al.
5,772,505 A 6/1998 Garczynski et al.
5,779,546 A 7/1998 Meissner et al.
5,803,808 A 9/1998 Strisower
5,941,769 A 8/1999 Order
5,944,310 A 8/1999 Johnson et al.
5,989,122 A 11/1999 Roblejo
6,019,368 A 2/2000 Sines et al.
6,039,650 A 3/2000 Hill
6,068,258 A 5/2000 Breeding et al.
6,093,103 A 7/2000 McCrea, Jr.
6,117,012 A 9/2000 McCrea, Jr.
6,126,166 A 10/2000 Lorson et al.
6,139,014 A 10/2000 Breeding et al.
6,149,154 A 11/2000 Grauzer et al.
6,165,069 A 12/2000 Sines et al.
6,165,072 A 12/2000 Davis et al.
6,217,447 B1 4/2001 Lofink et al.
6,250,632 B1 6/2001 Albrecht
6,254,096 B1 7/2001 Grauzer et al.
6,254,484 B1 7/2001 McCrea, Jr.
6,267,248 B1 7/2001 Johnson et al.
6,270,404 B2 8/2001 Sines et al.
6,293,546 B1 * 9/2001 Hessing et al. ..... 273/138.2
6,299,536 B1 10/2001 Hill
6,325,373 B1 12/2001 Breeding et al.
6,346,044 B1 2/2002 McCrea, Jr.
6,361,044 B1 3/2002 Block et al.
6,403,908 B2 6/2002 Stardust et al.
6,460,848 B1 10/2002 Soltys et al.
6,517,435 B2 2/2003 Soltys et al.

(56) References Cited

U.S. PATENT DOCUMENTS

| | | | |
|---|---|---|---|
| 6,517,436 | B2 | 2/2003 | Soltys et al. |
| 6,520,857 | B2 | 2/2003 | Soltys et al. |
| 6,527,271 | B2 | 3/2003 | Soltys et al. |
| 6,530,836 | B2 | 3/2003 | Soltys et al. |
| 6,530,837 | B2 | 3/2003 | Soltys et al. |
| 6,533,276 | B2 | 3/2003 | Soltys et al. |
| 6,533,662 | B2 | 3/2003 | Soltys et al. |
| 6,568,678 | B2 | 5/2003 | Breeding et al. |
| 6,579,180 | B2 | 6/2003 | Soltys et al. |
| 6,579,181 | B2 | 6/2003 | Soltys et al. |
| 6,588,750 | B1 | 7/2003 | Grauzer et al. |
| 6,588,751 | B1 | 7/2003 | Grauzer et al. |
| 6,629,894 | B1 | 10/2003 | Purton |
| 6,651,981 | B2 | 11/2003 | Grauzer et al. |
| 6,651,982 | B2 | 11/2003 | Grauzer et al. |
| 6,655,684 | B2 | 12/2003 | Grauzer et al. |
| 6,659,460 | B2 | 12/2003 | Blaha et al. |
| 6,676,127 | B2 | 1/2004 | Johnson et al. |
| 6,698,756 | B1 | 3/2004 | Baker et al. |
| 6,726,205 | B1 | 4/2004 | Purton |
| 7,036,818 | B2 | 5/2006 | Grauzer et al. |
| 7,900,923 | B2 | 3/2011 | Toyama et al. |
| 2002/0163125 | A1 | 11/2002 | Grauzer et al. |
| 2003/0064798 | A1 | 4/2003 | Grauzer et al. |
| 2003/0073498 | A1 | 4/2003 | Grauzer et al. |

FOREIGN PATENT DOCUMENTS

| | | |
|---|---|---|
| JP | 2008-246061 A | 10/2008 |
| WO | 87/00764 | 2/1987 |
| WO | 98/14249 | 4/1998 |
| WO | 98/40136 | 9/1998 |
| WO | 00/51076 | 8/2000 |

OTHER PUBLICATIONS

DVD Labeled "Luciano Decl. Ex. K". This DVD includes the video taped live Declaration of Mr. Luciano (see list of patents on the 1449 or of record in the file history) taken during preparation of litigation (Oct. 23, 2003).

DVD labeled Morrill Decl. Ex. A:. This DVD includes the video taped live Declaration of Mr. Robert Morrill, a lead trial counsel for the defense, taken during preparation for litigation. He is describing the operation of the Roblejo Prototype device. See Roblejo patent in 1449 or of record (Jan. 15, 2004).

DVD Labeled "Solberg Decl. Ex. C". This DVD includes the video taped live Declaration of Mr. Solberg, a witness for the defense, taken during preparation for litigation (Dec. 22, 2003).

DVD labeled "Exhibit 1". This is a DVD taken by Shuffle Master personnel of the live operation of a CARD One2Six™ Shuffler (Oct. 7, 2003).

Canadian Office Action for CA 2,580,309 dated Mar. 20, 2012 (6 pages).

Scarne's Encyclopedia of Games by John Scarne, 1973, "Super Contract Bridge", p. 153.

Specification of Australian Patent Application No. 31577/95, filed Jan. 17, 1995, Applicants: Rodney G. Johnson et al., Title: Card Handling Apparatus.

Specification of Australian Patent Application No. Not Listed, filed Aug. 15, 1994, Applicants: Rodney G. Johnson et al., Title: Card Handling Apparatus.

PCT International Search Report and Written Opinion of the International Searching Authority for PCT/US05/31400, dated Sep. 25, 2007, 12 pages.

Statement of Relevance of Cited References, Submitted as Part of a Third-Party Submission Under 37 CFR 1.290 on Dec. 7, 2012 (12 pages).

* cited by examiner

SHUFFLING DEVICES INCLUDING ONE OR MORE SENSORS FOR DETECTING OPERATIONAL PARAMETERS AND RELATED METHODS

CROSS-REFERENCE TO RELATED APPLICATION

This application is a continuation of U.S. patent application Ser. No. 10/940,420, filed Sep. 14, 2004, now abandoned, the disclosure of which is hereby incorporated herein by this reference in its entirety.

TECHNICAL FIELD

The present invention relates to card shufflers, particularly playing card shufflers, and the detection of jamming or erroneous mechanical performance in the operation of the shuffler.

BACKGROUND

Examples of shuffling devices for playing cards, particularly for use in casinos are described in U.S. Pat. Nos. 4,659,082; 6,659,460; 6,655,684; 6,651,982; 6,651,981; 6,588,751; 6,588,750; 6,568,678; 6,325,373; 6,267,248; 6,254,096; 6,149,154; 6,139,014; 6,068,258; 5,989,122; 5,695,189; 5,676,372; 5,584,483; 5,382,024; 4,832,342; and 4,586,712. In these known shuffling apparatuses, various different formats of randomizing cards are performed. In U.S. Pat. No. 4,659,082, the shuffling vessel is formed by a horizontally arranged drivable drum that is provided with radially extending shafts, each for receiving a card. An input station for receiving a stack of discarded playing cards is provided through which the individual shafts of the drum are supplied. The storage container for the shuffled cards is supplied by the drum. Following the activation of a card ejector, the individual cards are randomly pushed into the storage container. A similar card shuffler has become known from U.S. Pat. No. 4,586,712 in which the drum is vertical.

A high degree of shuffling is achieved with such card shufflers. The predictability of the card sequence in the shuffled card stack is difficult or virtually impossible for a third party even in the case of using electronic aids. In these known shufflers, there can be card storage means for individually retrieving the shuffled cards. This individual card movement requires significant control and may lead to certain disadvantages. For example, certain card shufflers may only be used for certain games, but not for such games where a removal in stacks of the shuffled cards is provided.

A card-shuffling apparatus with an output apparatus for retrieving cards is described in U.S. Pat. No. 5,683,085 that by way of a respective activation can be supplied from the shuffling storage means, not only with individual cards, but also with several cards, so that an entire stack of cards can be taken from the output apparatus.

U.S. Pat. No. 5,989,122 teaches a card-shuffling apparatus that also conveys entire playing card stacks to an intended output apparatus.

U.S. Pat. No. 5,303,921 teaches a floating jammed shuffle detector for use in a card-shuffling machine. The detector has a body with a card-contacting portion and a sensor interactive portion. A detector housing and a photosensor are provided. The sensor interactive portion has an aperture of a predetermined size. The detector, particularly the body, is reciprocally mounted in the housing, whereby the card-contacting portion of the detector contacts the uppermost card of a deck of cards and the sensor interactive portion is received in the photosensor. Depending on the sensed position of the card-contacting portion of the detector, the machine receives a "reshuffle" or "proceed" command. U.S. Pat. Nos. 6,068,258 and 5,695,189 also have disclosures on card jam detection and recovery.

U.S. Pat. No. 6,139,014 discloses a recovery method for recovering from a card jam in an apparatus for automatically shuffling cards, the apparatus including a card mover for moving the cards and sensors for monitoring movement of the cards wherein, during normal movement, the cards are moved substantially one at a time and the sensors are alternately blocked and unblocked. The recovery method comprises the steps of: sensing a prolonged blocked state, thereby indicating that the card jam has occurred; altering the normal movement of the cards; sensing an end of the prolonged blocked state; and resuming the normal movement of the cards.

U.S. Pat. No. 6,325,373 teaches a card shuffler comprising: a card-moving mechanism; a microprocessor for controlling operation of the card shuffler, including the card-moving mechanism; memory; a program stored in memory for controlling the card-moving mechanism; at least one detector for detecting the presence of a card jam; in response to detecting the presence of a card jam, the program automatically attempts to recover from the jam; and a multi-segment display for displaying the occurrence of a card jam.

The differentiation as to whether or not entire stacks of cards or merely individual cards are conveyed to the output apparatus is solved in U.S. Pat. Nos. 5,683,085 and 5,989,122 by electronic means. The output apparatuses per se remain the same and are therefore not believed to be adaptable to the different card games.

SUMMARY

Deficiencies in shuffler operation, including card jams can be electrically or electronically identified. Various physical events such as angular speed or linear speed of shuffler components (e.g., shafts, rollers, pushers, grips, elevators, etc.) can be determined in absolute or relative terms of speed. Threshold speeds, absolute speeds or relative changes in speed can be indicators of jamming or other performance deficiencies that indicate substandard performance. These indicators can be used to provide notice to an operator that such a deficiency is occurring and that it should be addressed.

BRIEF DESCRIPTION OF THE FIGURES

FIG. 3 shows some internal details of an output device for a shuffler as shown in

FIG. 1.

DETAILED DESCRIPTION

Figure 1:
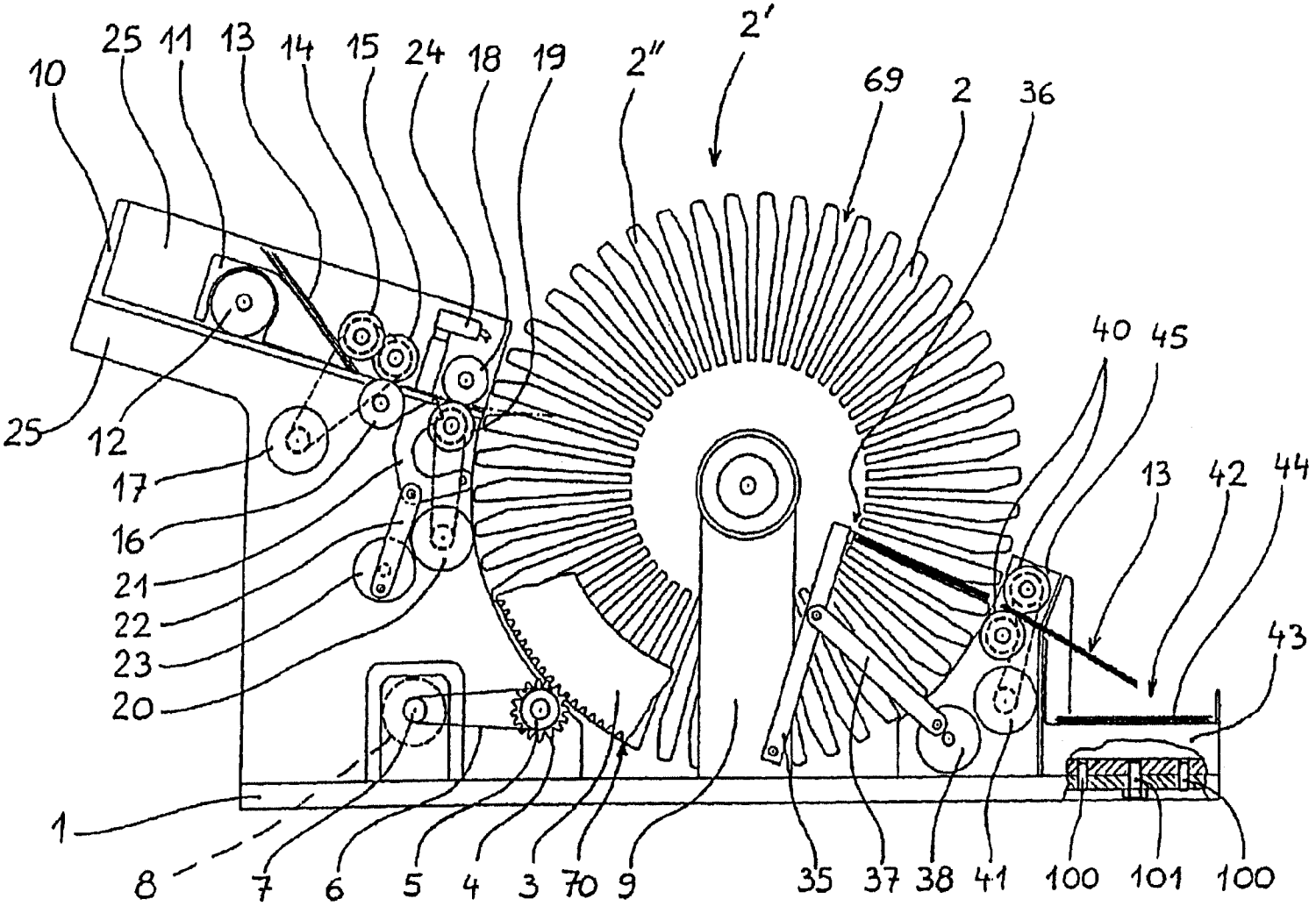
FIG. 1 schematically shows a card shuffler in accordance with the present teachings in which a cover has been removed.

In normal operation of a shuffling device, there are moving parts that operate to receive, move, orient, load, unload, insert, raise, or lower a single card, group of cards, or complete sets (e.g., decks) of cards. There are a number of reasons why these moving parts may change their quality of movement during a shuffling procedure. In addition to normal wear and deterioration of components, card jams can occur, even with the best designed and engineered products. As significant portions of the shuffling process and the shuffling operation may be hidden from view, there is not necessarily any visual indication that shuffling is not properly proceeding. Waiting until well past an expected end of the shuffling process to find that cards or hands of cards are not being delivered is both an inefficient way of determining shuffling status, and could lead to damage of the equipment if a non-functional shuffling process is stressing parts and components in the shuffler. In addition, failing to realize a shuffle did not take place can result in a loss of revenue to the casino.

Some previous jam detection systems have evaluated blocking and unblocking of sensors within a shuffler to determine that cards are present or are not present at appropriate times in a shuffling process. This has proved to be a good method for detecting certain forms of card jams, but alternative methods are possible. It is even possible with some alternative detection methods, which are included and described herein, to be able to anticipate potential apparatus breakdown and upcoming component problems with a jam detection system.

The herein described technology for determining card jams may be used with any of the various structures of shuffler and with any format of shuffling, as will later become apparent. All of the patent references noted above are incorporated herein by reference to enable manufacture of the underlying shuffler structures that can be used in combination with a jam detector and jam detection methodology described herein. The proposed measures of jam detection are therefore compatible with any shuffler that has moving parts, including but not limited to a) modular arrangements of the card shuffler, with an exchange of the card storage means for the shuffled cards being possible in a simple way; b) carousel shufflers; c) vertical or linear stacked arrays of mixing compartments, d) ejection shufflers; e) riffle shufflers; grip and lift insertion shufflers; and the like, as described in publicly available literature including but not limited to the references cited above.

An underlying aspect of the described detection technology is that moving parts within the shuffling system are expected to move at steady, consistent and/or repetitive rates at different stages of the shuffling operation. By observing, detecting, noting and/or measuring movement, acceleration or speed of movement, performance of individual sections, parts or components of the shuffler can be monitored from moment to moment or at specified time intervals or times during the shuffling operation. By having detection systems at significant or even all moving parts in the shuffler, specific locations of potential jams or adverse shuffling issues can be located and notice can be sent to a processor and/or display system on the shuffler or at a distal location (e.g., to a technician location or pit crew).

There are numerous different ways in which operation variation of moving elements can be observed in an effort to detect deficiencies. In addition to observing complete lack of movement of a specific component, delayed movement, erratic movement, varied acceleration, changing movement (within a single operation or over time), incomplete movement, and the like can be observed. The indications of what will be generically referred to as "speed" (which will be inclusive by definition of linear speed, angular speed, acceleration, start and stop movement, time of movement, and consistency of movement) can be provided by many different methodologies. These methods include, but are not limited to measurement of power utilization by specific components, measurement of torque applied to elements, measurement of forces applied to individual elements, electronically or electromechanically observed/detected/measured speed of elements, magnetically detected flux alterations from moving parts, optically (electro-optically) observed/detected/measured speeds and the like. Descriptions of these forms of detection are provided herein.

When specific components are operating improperly, as when cards are jammed into a specific roller pair, or when cards are not present in a roller pair when they are intended to be present during shuffling, local power consumption of the motor driving the rollers will be different than expected. By measuring power consumption of specific areas of the shuffler, jam detection can be effected by measuring/observing/noting specific levels of change in local power consumption within the shuffler. Where reduced power consumption is observed, it is likely that cards have not been fed to that location. Where a predetermined degree of increased power consumption is noted, it is likely that one or more cards are jammed at that location, and that the local element is expending excess power in attempting to move the card or cards.

Similarly, measurement of torque or available force in the movement of moving parts (rotating elements and linear moving elements, respectively, for example) can be used to detect/observe/measure for the occurrence of card jamming in the shuffler. When a component (e.g., a card pusher or a set of rollers) is operating properly, it has a power capability that can be measured. For example, by providing a belt to a roller, the force applied by the roller (or shaft driving the roller) can be measured. That force is expected to be a measurable amount when the component is moving cards and when it is not moving cards (either in a free-rolling mode or when moving prior to receiving a card). By measuring the torque on the shaft, it can be determined if there is a variation in the amount of available torque that can be explained by a card jam or lack of card feed to that component.

Similar to measurement of torque in rotational movement of parts, linear movement of elements (such as a card pusher or gripping element) is expected to be able to provide force in a measurable range. If a spring or other tension element is present which can be used to measure or observe specific linear forces and provide a signal indicative of that force, the occurrence of events that alter the expected force can be observed and detected, such as where a card jam is preventing proper or complete movement of the element or where the absence of a card allows that element to provide greater force than expected.

Electronically or electromechanically observed/detected/measured speed of elements can be provided with any system that actually measures the linear or angular speed of a component, as with a speedometer, an odometer and timing component, distance measuring element without associated time component, and the like associated with specific elements. For example, distance alone can be an effective indication of a jam where a particular element is known to have to traverse a specific distance to effect its function (e.g., a card pusher or hand pusher must move exactly 10 centimeters to unload cards or hands). If the element is found to be moving less than its required distance, there can be an assumption that its movement is being blocked (as with a card jam). Therefore, upon each operation of that element the distance it traverses is measured, and where the measured distance is insufficient, there is an indication of a possible card jam or other system malfunction. Similarly, if an element is moving too slowly or too fast, that could provide an indication that no cards are being provided (and hence the element is moving faster than expected) or that cards are jammed (and so the element is moving slower because of blockage or friction from jammed cards). The measurements may also be taken on an individual (single) movement of an element or over time to measure an ongoing, repeated event as the signal. As simple an element as a free rolling wheel pressing against the moving surface can provide the distance measurements whenever the element moves. This would be subject to wear, however and would not be a most preferred embodiment.

In one embodiment described herein, an element on a moving part has a measurable/detectable magnetic component to it. As is well known, when a magnet moves, its magnetic field moves, and the rate of the movement can be easily detected either by forces generated on an electrical current or by the generation of an electrical current in a conductive medium that is stationery in the moving field. An ammeter, voltmeter, or other device can be present. The movement of the field through an area or volume of space (flux) can be easily measured and used as a basis for determining if parts, especially rollers or roller shafts, are moving properly. The magnetic elements may be provided outside the card movement area so that detection of the flux variations can also be made outside of the card movement area. The difference in magnetic element location is a design feature that should improve some attributes of the device, but location within the card movement area is also possible.

The detection system may also be based upon optically (electro-optically) detected movement. For example, fiduciary marks or optically sensible marks may be placed on the outside (especially axially end or outside) of the roller or roller shaft. An optical reading or sensing element (e.g., a camera) observes the movement of the marks and determines its speed (as generically defined above). The data from the camera images can be readily used to indicate the speed of the element, which can again reflect a change in machine performance and especially a card jam. A strobe light may be placed outside the moving element or on the moving element, and the movement of the emitted light may be observed. Combinations of these various systems may also be provided within the shuffler to give more detailed or more sophisticated data from which determinations of shuffler performance may be based.

Many variations and designs in shufflers, as noted above, are possible for use in combination with the jam detection of the present invention. With respect to a carousel-type shuffler (with a full carousel or slots forming only a partial circle or fan of compartments), a card storage means for the individual retrieval of cards can be replaced, for example, very simply by one for the retrieval of cards in stacks and vice-versa. Principally, the receiving means can be provided with any desired arrangement and can comprise beveled edges, grooved and/or spring-shaped entrances to the respective compartments, for example, with which the card storage means and the basic body mutually engage. The positioning or fixing of the respective elements can be provided by means of a fixable alignment pin, for example. It is also possible, however, to provide connections by clips or snap-in connections such as spring-loaded balls or pins as receiving means for the card storage means and which latch into respective latching recesses of the card storage means or the basic body of the shuffler.

In one embodiment, the content of each compartment of the shuffler's storage means is securely pushed into a nip line between two rollers during the output, which conveys the same into the card storage means for the shuffled cards. This also allows shuffling more than one card into a compartment of the shuffling storage means and thus keeping the card shuffler relatively small. This allows operating such a shuffler on a game table even when a larger number of card stacks, such as six or eight, are in the game and need to be managed. The nip rollers can either be provided with an elastically deformable coating or be pressed in a resilient way against one another, which also allows an adjustment to the thickness of the content of the compartment to be ejected which can also hold several cards, e.g., a card stack with nine or more cards. The stacks may contain zero, one or more cards at different times in the shuffling process.

In one embodiment, the card-shuffling storage means is a drum having radially arranged compartments. The cards are held in the individual compartments and cannot slip outwardly by centrifugal force and thus prevent any contact of the cards with a housing enclosing the drum. This leads to a very substantial protection of the cards.

Moreover, in the case of any required exchange of a drum, it is not necessary to remove the cards from the compartment of the same. Instead, the drum including the cards contained in the same can be exchanged.

In one embodiment, a card sensor is provided to detect the cards used in a game. It is not only possible to check their number, but also the card picture, as a result of which any changes to the cards can be recognized.

Some of the exemplary embodiments of this described technology are now explained in closer detail by reference to the enclosed drawings, wherein:

FIG. 1 schematically shows a card shuffler S in accordance with the present teachings in which a cover (not shown) has been removed.

Figure 2:
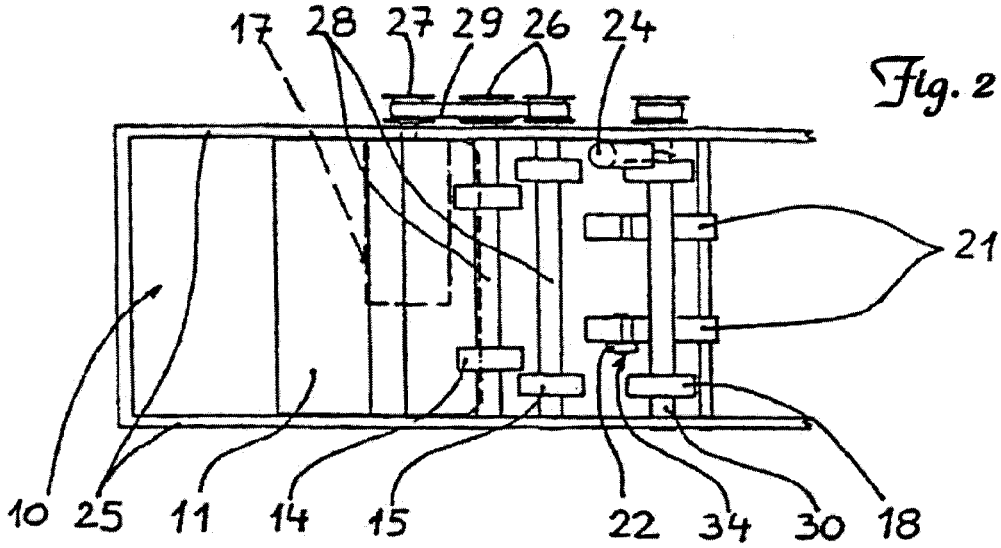
FIG. 2 shows a top view of a card input device for a shuffler as shown in FIG. 1.

FIG. 2 shows a top view of a card input device CI for a shuffler as shown in FIG. 1.

Figure 3:
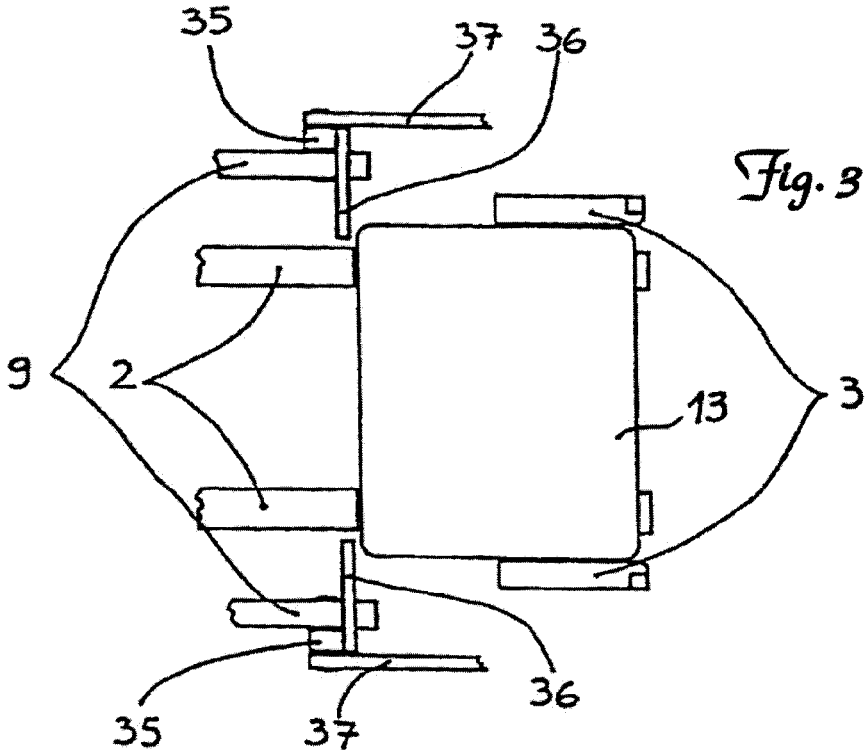

FIG. 3 shows some internal details of an output device OD for a shuffler as shown in FIG. 1.

Figure 4:
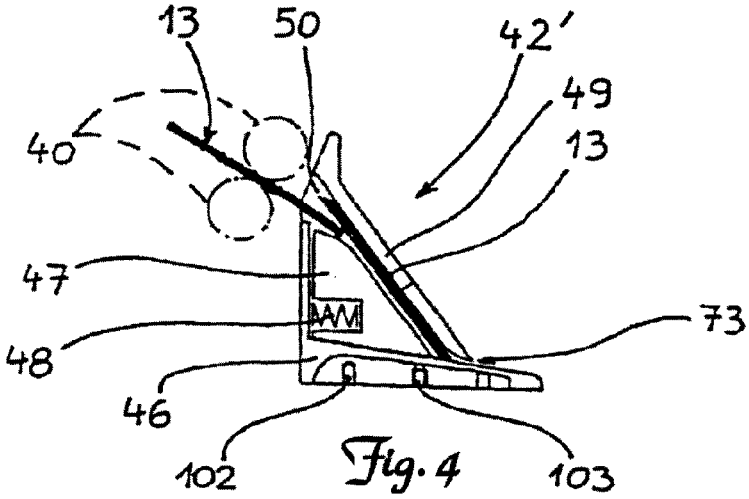
FIG. 4 shows a card storage component for one-by-one output of shuffled cards from a shuffler as shown in FIG. 1.

FIG. 4 shows a card storage component 42' for one-by-one output of shuffled cards 43 from a shuffler as shown in FIG. 1.

Figure 4A:
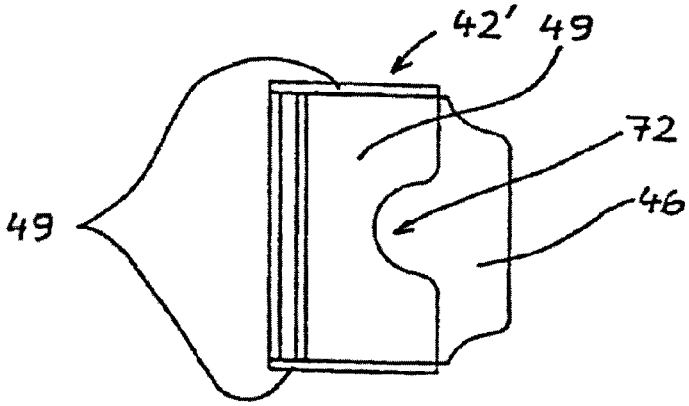
FIG. 4A shows a top view of card storage compartment according to FIG. 4.

FIG. 4A shows a top view of card storage compartment 42' according to FIG. 4.

Figure 5:
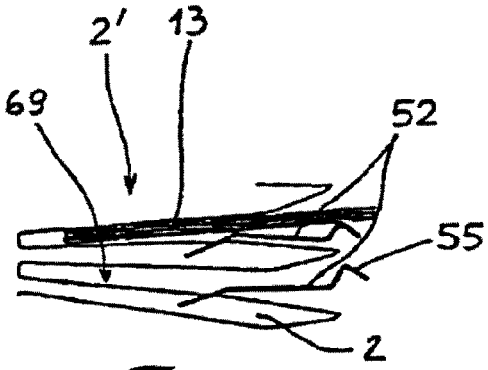
FIGS. 5 and 5A show details of variants of the arrangement of compartments of the shuffling storage compartments.
Figure 5A:
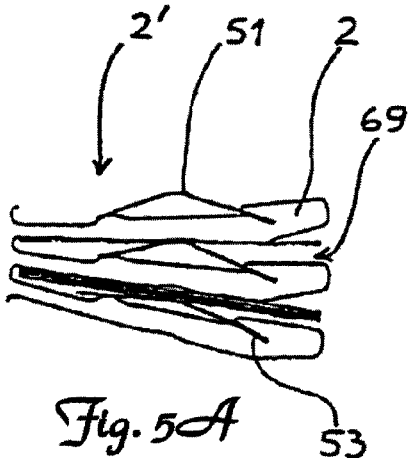

FIGS. 5 and 5A show details of variants of the arrangement of compartments 69 of the shuffling storage compartments.

Figure 6:
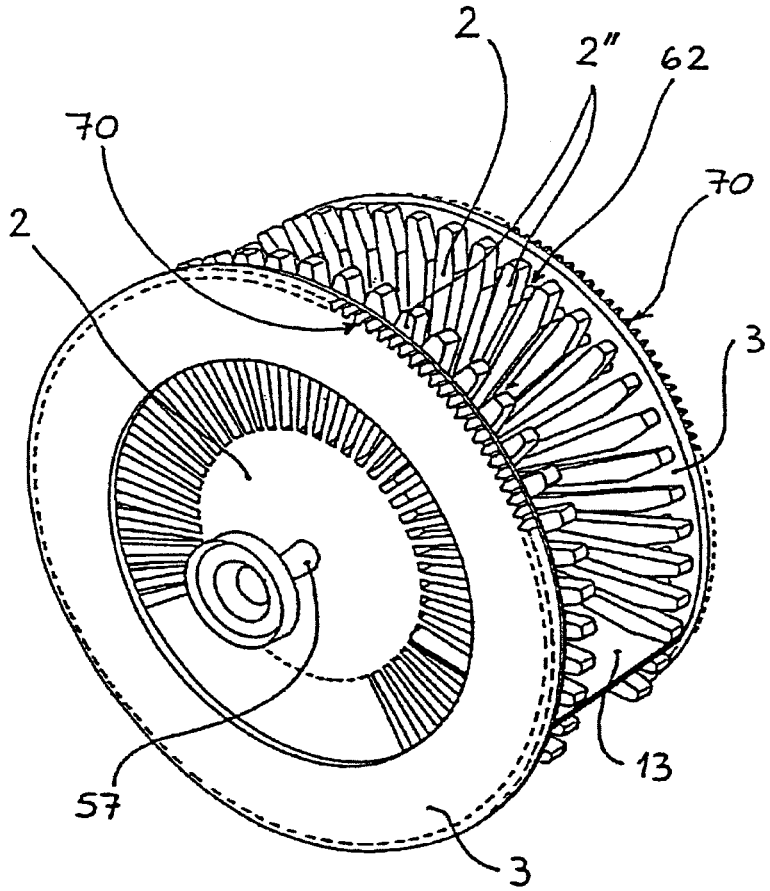
FIG. 6 shows an axonometric or perspective representation of the shuffling storage means for a shuffler as shown in FIG. 1.

FIG. 6 shows an axonometric or perspective representation of the shuffling storage drum 2 for a shuffler as shown in FIG. 1.

Figure 7:
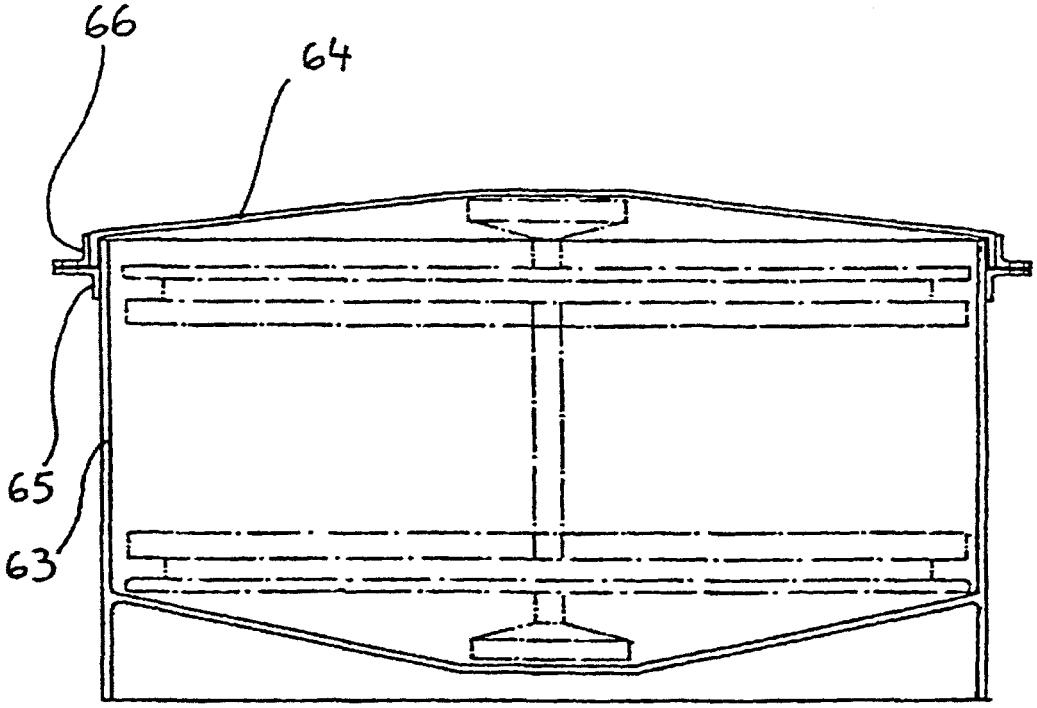
FIG. 7 shows a security container with a shuffling storage means.

FIG. 7 shows a security container 63 with a shuffling storage means.

Figure 8:
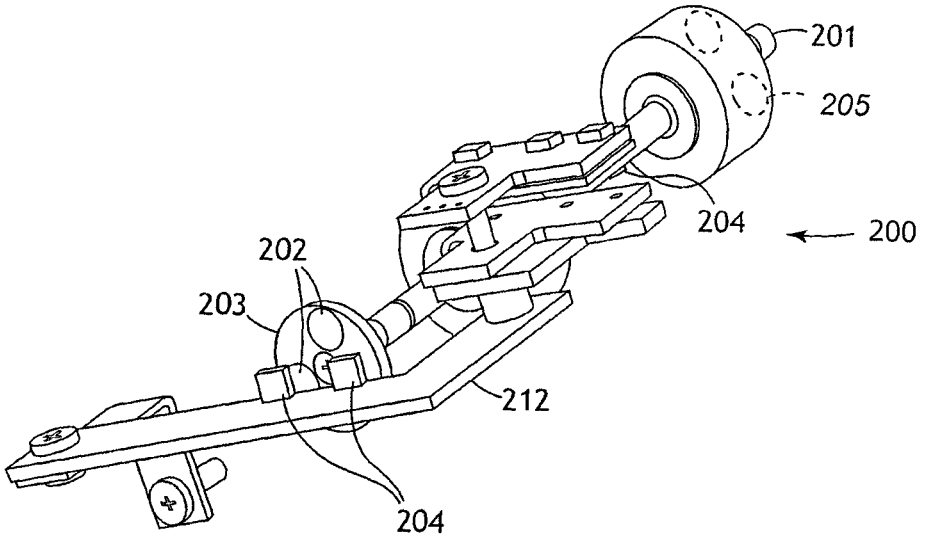
FIG. 8 shows a perspective view of a card feed roller assembly having magnetic plates to assist in detection of jams.

FIG. 8 shows a perspective view of a card feed roller assembly 200 having magnetic plates 202 to assist in detection of jams.

Figure 9:
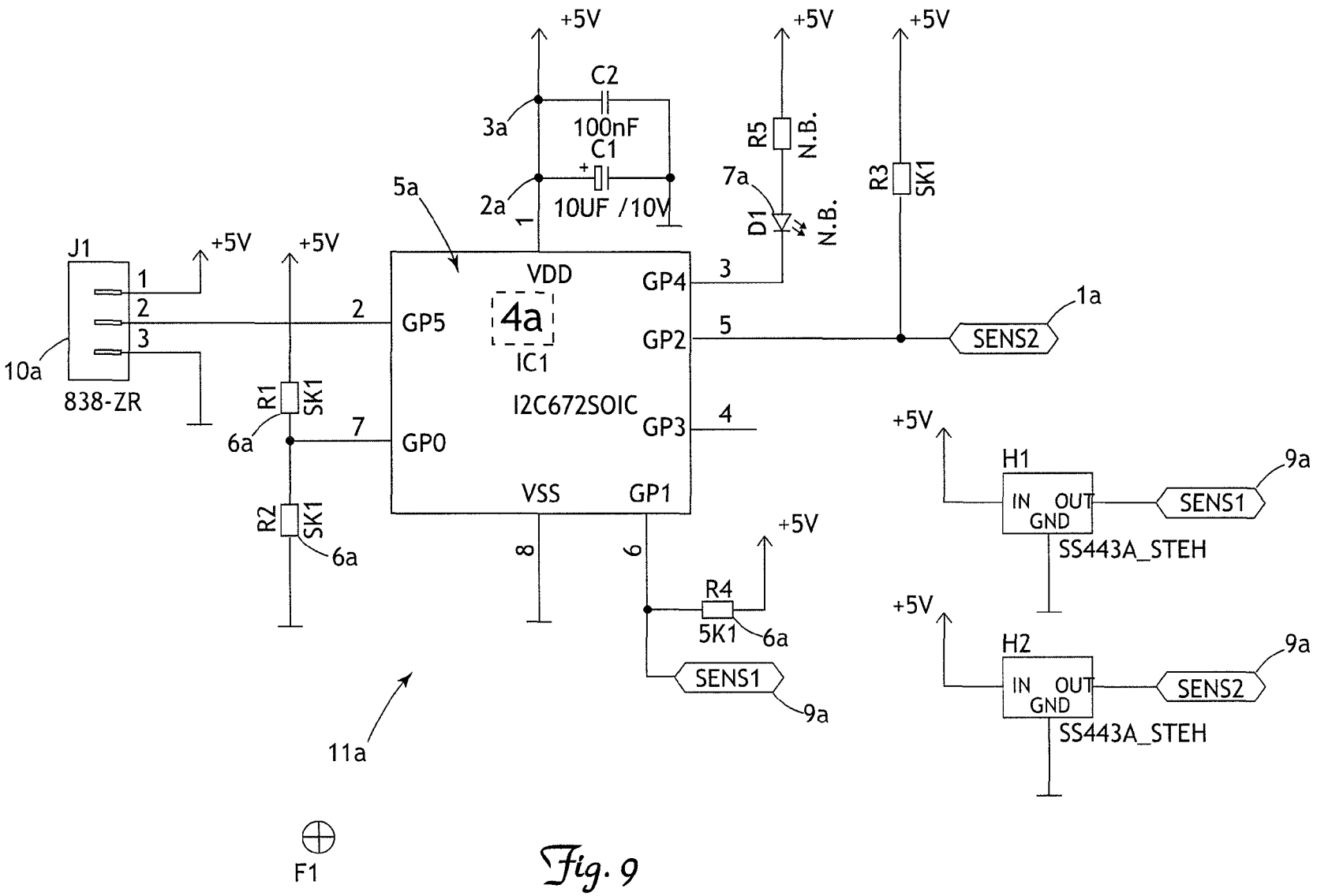
FIG. 9 shows a schematic of a circuit design useful with a magnetic jam detector.

FIG. 9 shows a Programmable Integrated Circuit (PIC) board 11*a* that contains solid state sensors.

FIG. 1 shows that on a base plate 1, a shuffling storage element 2' is disposed on a console formed by two legs 9, which shuffling storage element 2' is formed by a rotatably held drum 2. The drum 2 is connected to two disks 3 via spacers 62 (FIG. 6). The flanges 2" of the drum 2 are provided with compartment-like slots or trays 69 which are designed for receiving cards. The disks 3 are each provided with a circumferential friction engaging elements, gearing or teeth 70. The shuffling storage element 2' can be driven via a pinion 4 and an engaging pulley (e.g., a toothed pulley) 5 that is rigidly connected to the same and are jointly held rotatably in plates 25, and a toothed belt 6 via a second toothed pulley 7 and a motor 8, as shown in phantom. The motor 8 is triggered via a randomizer and optionally also moves the shuffling storage element 2' in mutually opposite directions, so that an oscillating movement of the shuffling storage element 2' can occur. This oscillating movement may also be incorporated into an automatic jam recovery movement or sequence that can be programmed into a processor driving the shuffler.

A reservoir 10 for discarded (unshuffled, used decks, new decks) cards 13 is provided, which is part of an input apparatus. The reservoir 10 comprises a wedge 11 that may be rolled off by a roller 12 that is arranged rotatably within the reservoir 10 on an inclined floor of the reservoir 10 against two rollers 14, which should be able to gently engage the cards 13 on the roller surfaces, as with a non-abrasive friction surface such as rubber or elastic (FIG. 2). Referring also to FIG. 2, the two rollers 14 are rotatably held in the two plates 25 on a common shaft 28 and can be driven by way of two belt pulleys 26, a toothed belt 29 as well as a belt pulley 27 via a motor 17 jointly with the rollers 15. Two rollers 16 touch the two rollers 15 on the circumference, so that they can be co-rotated by surface friction.

A sensor 24 is shown to be provided as a line or pixel sensor for recognizing the card symbol of the respectively moved card 13. The pair of rollers 19 (only one of the pair is shown due to the angle of view) and the pair of rollers 18 (only one of which is shown due to the angle of view) which touch the same card on the circumference of each roller and are each situated on a shaft 30 and can be driven in the same manner as described above by motor 20.

The two levers 21 are used for the complete insertion of the respectively moved card into a compartment 69 of the shuffling storage element 2' and are drivable in an oscillating or reversible manner by way of a rod 22 that is reciprocally or swivelably connected with the lever 21 by an axle 34 by way of an eccentric disk 23 disposed on the motor 20.

At least two variants are described herein for the card storage means 42, 42' (FIGS. 4 and 4*a*) for the shuffled cards 13, which storage means 42, 42' can optionally be fastened to the base plate 1 and can easily be mutually exchanged. A receiving means is provided which comprises two alignment pins 100 which are inserted in the base plate 1 and on which a card storage means 42, 42' for shuffled cards can be inserted. The card storage means 42, 42' is provided with respective bores 102 (FIG. 4) in its base. To fix or secure the respective card storage means 42, 42', a screw 101 is provided which engages in a threaded bore 103 of the card storage means 42, 42'. A receiving means for the card storage means 42, 42' can also use clip connectors to connect to the card storage means 42, 42', or a recess can be formed in the base plate 1 into which the card storage means 42, 42' can be inserted.

The output of cards 13 from the compartments 69 into a card storage means 42, 42' is performed by means of two swivel arms 35 that are swivelably held in the two legs 9 and are drivable in an oscillating manner by way of levers 37 and by way of an eccentric disk 38 situated on a motor. Two swivel arms 35 each carry at their upper ends an inwardly positioned rail 36 (FIG. 3) that grasps the cards 13 disposed in a compartment 69 and conveys them to a nip gap of two grip rollers 40. The grip rollers 40 are held in plates 45 and are simultaneously drivable by a motor 41.

The grip rollers 40 convey the respectively moved cards 13 either into the card storage means 42 for the shuffled cards as shown in FIG. 1 for a stack-by-stack removal of the cards 13, or into a card storage means 42' (as shown in FIGS. 4 and 4A) for a one-by-one removal of shuffled cards.

The card storage means 42 is substantially formed by a U-shaped table 43 in which the cards 13 are deposited in a stack 44. The cards can be removed upwardly by the croupier stack-by-stack if necessary.

The card storage means 42' according to FIGS. 4 and 4A is provided for a one-by-one removal of cards 13. The cards 13 emerging from the nip gap of the grip rollers 40 enter the card storage means 42' through a gap 50 that is shown to be optionally limited by an oblique downwardly extending wall 49 and a spring-loaded shoe 47. The cards 13, which as a group may also include several of the cards simultaneously, are pushed between the shoe 47 and the wall 49 or the cards already disposed in the card storage means 42', with the shoe 47 being pushed back against the force of a spring 48. The shoe 47 slides over an inclined plane of an L-shaped basic body 46. A gap 73 remains between the lower edge of the wall 49 and the L-shaped basic body 46, through which gap 73, the cards 13 can be retrieved one-by-one.

As is shown in FIG. 4A, the inclined wall 49 is provided at its lower edge with a centrally arranged recess 72 that is open on its edge and facilitates the withdrawal of the individual cards. The card storage means 42' is limited on the side by walls 49. The shuffled cards can be retrieved by the croupier individually in that the respectively foremost of the playing cards 13 is grasped through recess 72 in the wall 49 and is pulled through the gap 73.

As is shown in FIGS. 5 and 5A, springs 51, 52 are arranged in the compartments 69 of the shuffling storage element 2', which springs 51, 52 ensure the clamping of the card(s) 13 inserted into the respective compartment 69.

The spring 52 is provided with a securing element such as a bent strip or spring 55 that covers the radially outer openings of the compartments 69 and securely prevents cards from being ejected outwardly by centrifugal force during the rotation of the shuffling storage element 2' or falling out if tilted in a downward direction.

The springs 51 according to FIG. 5A are arranged as curved or bent leaf springs and are inserted in a slot 53 of the one wall of the compartment 69 and press against the respectively opposite wall of compartment 69. The card inserted into the respective compartment 69 is clamped between the spring 51 and the opposite wall of compartment 69 and held in this way in the respective compartment 69.

The output of the cards of a compartment 69 is carried out in such a way that the card 13 or a stack of up to nine cards, for example, is ejected by force. This is carried out by means of the swivel arms 35 and rails 36, as already explained above. The springs 51, 52 are deformed during the ejection of the card(s) 13.

As is shown in FIGS. 1 and 6, drum 2 rests with axle journals 57 in receiving means of legs 9 and can be removed or lifted from the same with ease. Since the compartments 69 are provided with springs 51, 52, the cards 13 can remain in their compartments 69 during the removal of drum 2.

The drum 2 can be placed in a security container 63 (FIG. 7) and can be transported in the same, with the container 63 being sealable with a lid 64. For this purpose, flanges 65, 66 are fastened on container 63 and the lid 64. This allows connecting the container 63 with the lid 64 in a manner so as to be secure against manipulations or to lock the same.

It has been mentioned previously that not only may card jams be detected, but that other shuffling deficiencies may be detected or even predicted. For example, variations in the speed of movement of rollers can provide an indication that rollers are wearing out, causing uneven movement of cards or eccentric movement of cards through the shuffling device. Specific types of signals can be interpreted by the processor as indicative of wear rather than jamming. Power surges that are not associated with specific movements of the elements of the shuffling device can be indicative of a short circuit developing or occurring in the electronics or wiring of the shuffling device. Eccentric movement of rollers or elements on the rollers can be an indication that components have become loose within the shuffling device and need to be secured. Speed or force variations with specific cards in the set of cards being shuffled (which occurrence of specific cards can be defined by the card-reading capability of the shuffling device) can be indicative of a damaged, marked, or foreign card in the set of cards.

FIG. 8 shows a perspective view of a card-moving component 200 having a rotational shaft 201 bearing a disk 203 embedded with a plurality of magnetic elements 202 (which may also be an optically marked element) and the disk 203 attached to the end of the shaft 201. A detection system 204 for the magnetic field created by the magnetic element 202 (or optical camera for an optically marked element (not shown)) is used to provide signals to a processor (not shown).

As noted above, the jam detection system described herein may be used with all of the various formats and designs of shuffling devices that are known in the art, as long as there is a moving part that can be used for detection purposes. For example, U.S. Pat. No. 6,149,154 describes a commercial shuffler known as the ACE® shuffler produced by Shuffle Master, Inc. This device (as described in the abovementioned patent) may be variously described as an apparatus for moving playing cards from a first group of cards into plural groups, each of the plural groups containing a random arrangement of cards, the apparatus comprising: a card receiver for receiving the first group of unshuffled cards; a single stack of card-receiving compartments generally adjacent to the card receiver, the stack generally adjacent to and movable with respect to the first group of cards; and a drive mechanism that moves the stack by means of translation relative to the first group of unshuffled cards; a card-moving mechanism between the card receiver and the stack (preferably comprising a plurality of shaft-mounted rollers); and a processing unit that controls the card-moving mechanism and the drive mechanism so that a selected quantity of cards is moved into a selected number of compartments. The apparatus may further comprise a second card-moving mechanism adapted to empty one of the compartments after a selected quantity of cards is moved into one of the compartments. The apparatus may also comprise a second receiver for receiving the cards the second card-moving mechanism moves out of the compartments. The stack is preferably vertically translatable in that design. The ACE® shuffler may also be described as a playing card handler comprising: a generally vertically oriented stack of mixing compartments for accumulating cards in at least one compartment; a microprocessor programmed to randomly select the compartment that receives each card in a manner sufficient to accomplish randomly arranging the cards in each compartment, wherein the microprocessor is programmable to deliver a preselected number of cards to a preselected number of compartments; a card-staging area for receiving a stack of cards to be handled, wherein the staging area and stack of mixing compartments are movable with respect to each other; a drive mechanism responsive to output signals from the microprocessor for causing relative movement between the staging area and the stack of mixing compartments; a card ejection device for moving a card from the staging area into one of the mixing compartments; and an input, operably connected to the microprocessor, that communicates a number of game participants and a number of cards to be dealt to each participant to the microprocessor. The ACE® shuffler may also be described as an apparatus for moving playing cards from an unshuffled group of cards into a plurality of hands, each hand containing a random arrangement of the same quantity of cards, the apparatus comprising: a card receiver for initially receiving the unshuffled group of cards; a single stack of card-receiving compartments generally adjacent to the card receiver, the stack generally vertically translatable; a card-moving mechanism between the card receiver and the stack; and a processing unit that controls the card-moving mechanism and the vertical movement of the stack so that a card is moved from the receiver into a randomly selected compartment and so that a selected number of cards are moved into a selected number of compartments.

Another successful commercial shuffler that can incorporate the jam detection technology described herein is the KING® shuffler from Shuffle Master, Inc. as described in U.S. Pat. No. 6,254,096. That shuffler may be variously described as an apparatus for continuously shuffling playing cards, the apparatus comprising: a card receiver for receiving a first group of cards; a single stack of card-receiving compartments generally adjacent to the card receiver, the stack generally vertically movable, wherein the compartments translate substantially vertically, and means for moving the stack; a card-moving mechanism between the card receiver and the stack (preferably comprising a plurality of shaft-mounted rollers); a processing unit that controls the card-moving mechanism and the means for moving the stack so that cards placed in the card receiver are moved into selected compartments; a second card receiver for receiving cards from the compartments; and a second card-moving mechanism between the compartments and the second card receiver for moving cards from the compartments to the second card receiver. The apparatus may further comprise a second card-moving means for emptying the compartments into the second card receiver. The apparatus may also further comprise a card present sensor operably coupled to the second card receiver. The apparatus may also move cards from the compartments into the second card receiver in response to a reading from the card present sensor. The KING® shuffler may also be described as a card handler comprising: a card-staging area for receiving cards to be handled; a plurality of card-receiving compartments, the compartments generally vertically stacked, and the card-staging area and the compartments are relatively movable, wherein the compartments translate substantially vertically. The apparatus may have a card mover generally between the staging area and the compartments for moving a card from the staging area into one of the compartments and a microprocessor programmed to identify each card in the staging area and to actuate the card mover to move an identified card to a randomly selected compartment. The microprocessor should be programmable to deliver a selected number of cards to a compartment; and there should be compartment moving components responsive to the microprocessor for moving the compartments. It is desirable to have inputs operably coupled to the microprocessor for inputting information into the microprocessor.

The KING® shuffler may also be described as a playing card handler comprising: a generally vertically oriented stack of compartments for accumulating cards in at least one compartment, wherein the compartments translate substantially vertically; a microprocessor programmed to randomly select the compartment which receives each card in a manner sufficient to accomplish randomly arranging the cards in each compartment, wherein the microprocessor is programmable to deliver a selected number of cards to a selected number of compartments; a card-staging area for receiving a stack of cards to be handled, wherein the stack of compartments is movable with respect to the card-staging area; a first card mover responsive to output signals from the microprocessor for moving cards between the staging area and the stack of mixing compartments; and a second card mover for moving cards from the compartments to a second card receiver.

Another commercial shuffling device is known in the art as the MD2® (Multi-Deck 2) and is commercially available from Shuffle Master, Inc. This shuffler is described in U.S. Pat. No. 6,651,982 and may be variously described as a device that moves cards from a first group of cards and randomly moves the cards into an accumulating randomized set of cards by randomly separating the randomized set of cards into at least two segments and inserting one card at a time from the first group of cards into a space between the two segments. The MD2® may also be described as a device for forming a random set of playing cards comprising: a top surface and a bottom surface of the device; a card-receiving area for receiving an initial set of playing cards; a randomizing system for randomizing the order of an initial set of playing cards; a collection surface in a card collection area for receiving randomized playing cards, the collection surface receiving cards so that all cards are received below the top surface of the device; an elevator for raising the collection surface so that at least some randomized cards are elevated at least to the top surface of the device; and an automatically moveable cover over the elevator. The MD2® may have the elevator raise all randomized cards above the top surface of the device and the automatically moveable cover is raised to allow the randomized cards to rise above the top surface of the device. The moveable cover may be raised by an element moving in concert with the elevator or an elevator drive system. The card-receiving area can be sloped to assist movement of playing cards towards the randomizing system. At least one shaft-mounted rotatable pick-off roller may remove cards one at a time from the card-receiving area and move cards one at a time towards the randomizing system. At least one pair of rollers may receive cards from the at least one pick-off roller.

A microprocessor controls movement of the pick-off roller and the at least one pair of rollers. The microprocessor may be programmed to direct the pick-off roller to cease propelling a first card being moved by the pick-off roller when it is sensed that the first card is being moved by the at least one pair of rollers. When a first card being moved by the pick-off roller is being moved by the at least one pair of rollers, movement of the pick-off roller may be altered so that no card other than the first card is moved by either the pick-off roller or the at least one pair of rollers. Tension on the first card may be effected by the at least one pair of rollers causing the pick-off roller to freely rotate and to not propel the first card. The randomization system may move one card at a time into an area overlying the collection surface. The device may operate by one card at a time being positioned into a randomized set of playing cards over the collection surface. The collection area may be bordered on two opposed sides by two movable card-gripping elements and an insertion point to the card collection area is located below a bottom edge of the two movable card-gripping elements. The card collection surface may be vertically positionable within the card collection area.

The MD2® may be alternatively described as a device for forming a random set of playing cards comprising: a top surface and a bottom surface of the device; a receiving area for an initial set of playing cards; a randomizing system for randomizing the initial set of playing cards; a collection surface in a card collection area for receiving randomized playing cards; an elevator for raising the collection surface within the card collection area; and at least one card-supporting element within the card collection area that will support a predetermined number of cards within the card collection area and suspends at least a subgroup of cards from the randomized cards over the card collection surface to create a card insertion opening.

Still another format for a shuffling device is shown by the Random Ejection Shuffling (RES) format described, by way of example, in U.S. Pat. No. 5,584,483. The RES shuffler may be described as a shuffling device in which cards are randomly ejected out of a first set of cards, transported to a card-receiving area, and collected on the card-receiving area as a randomized set of cards. An alternative description is as an automated playing card shuffler comprising: an infeed array holder for holding an infeed array of unshuffled playing cards; a shuffled array receiver for holding a shuffled array containing shuffled playing cards; a plurality of movable ejectors mounted adjacent the infeed array holder for ejecting playing cards from the infeed array holder at various card discharge positions, the playing cards ejected by the plurality of ejectors being received in the shuffled array receiver. The RES card shuffler may have the plurality of ejectors mounted upon at least one ejector carriage that is movable relative to a frame. The infeed array holder may be movable relative to a frame. The plurality of ejectors and the unshuffled array holder may be mounted to provide relative linear motion therebetween. The RES playing card shuffler may further comprise at least one extractor that engages playing cards that are displaced by the plurality of ejectors. The RES playing card shuffler may still further comprise at least one removal resistor that provides counteractive force opposing displacement of playing cards.

FIG. 9 shows a circuit design that can be included within a shuffling device as described herein for use with the magnetic jam detectors. This circuit design can be used with a processor to implement the operation of jam detection in a software program (as shown in the Appendix, herein) with a carousel shuffling system as described herein.

The list of components in the circuit design of FIG. 9 is:

1*a*) Jam detection sensor
2*a*) Tantalum chip capacitor
3*a*) Chip monolithic ceramic capacitor
4*a*) Actual program that is on the microchip controller
5*a*) Microchip (8-pin, 8-bit CMOS Microcontroller with A/D converter and EEPROM data memory)
6*a*) Resistor
7*a*) Capacitor
9*a*) Solid state sensor (Digital Position Sensor)
10*a*) ZH series header (3 Circuit/Pin connector), A circuit board 11*a* comprises the microchip 5*a* having ports to the jam detection sensor 1*a*, the tantalum chip capacitor 2*a*, the chip monolithic ceramic capacitor 3*a*, and the ZH series header 10*a*. There are various solid state sensors 9*a*, one shown in parallel to one of the three shown resistors 6*a*. An actual program 4*a* is embedded in the microchip 5*a*. Other elements on the circuit design, such as the capacitor 7*a*, while a Press Nut 2.5 mm (used to increase thread depth, made for plastic) is not shown on the microchip 5*a*.

The Programmable Integrated Circuit (PIC) board 11*a* contains solid state sensors 9*a*. Sensor 9*a* senses the magnetic field created by the three magnets (202) embedded in the disk 203. A microchip 5*a* is provided that interprets the signals of the magnetic sensors 9*a*. The software program shown in the Appendix may be used in one example of a practice of the invention, as with a carousel shuffling mechanism to create a signal representative of a jam, which would be further interpreted and acted upon by the jam detection sensor 1*a*. The PIC 11*a* board sends a signal to a system control board (not shown), and the system control board may then initiate a jam recovery sequence or provide a visible or audible or machine readable signal that a jam has occurred. When a jam recovery sequence is initiated, an exemplary sequence might include the reversing of direction of rotation of rollers, altering the direction of movement of linear elements (including a slight rotational, flapping, or pronating/twisting motion), and then resuming normal movement. This reversal or alteration of normal component movement may be practiced once, twice, thrice or a fixed finite number of times in an attempt to clear a jam automatically. If the predetermined or random number of recovery attempts does not clear the jam, the microprocessor or system control board or central processing unit sends a signal to a display that can provide directions or a signal identifying the jam and indicating that the operator must address the jam. The signal could be as simple as a light, or as complex as a digital read out, LED, LCD, plasma screen or other display that can provide alphanumeric displays to the operator identifying the issue with sufficient clarity (such as location of the jam, nature of the jam, severity of the jam, etc.) so as to assist the operator.

Referring back to FIG. 8, the card-moving or card drive element 200 has a friction engaging roller 205 attached to a shaft 201. Attached to one end of the shaft 201 is a plate 203. On the plate 203 are embedded magnets 202. Only two magnets 202 are shown because of the perspective of the figure and another magnet being obscured by frame 212. Supported on the frame 212 are two magnetic field detectors 204. In one example of the invention, Hall Effect sensors are utilized.

Figure 10:
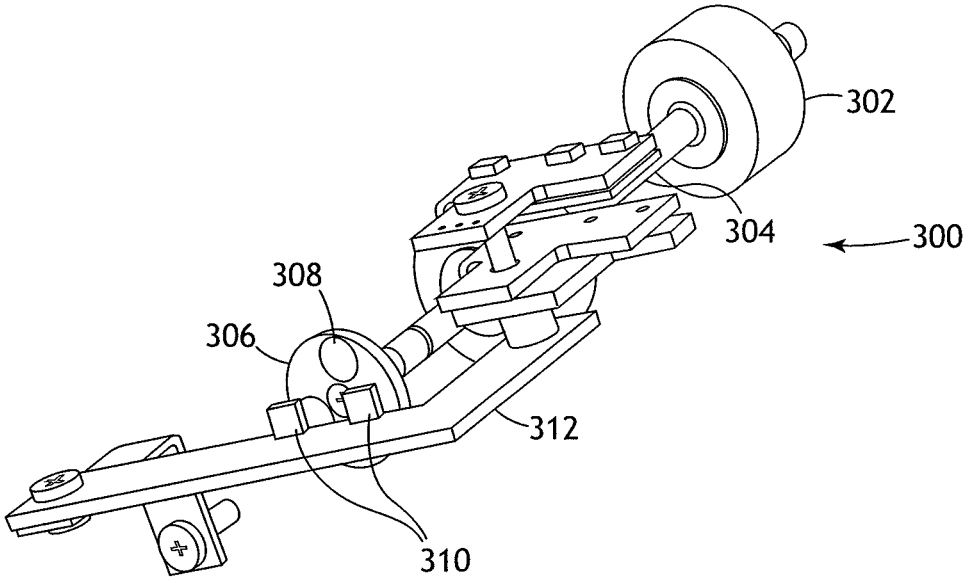
FIG. 10 shows a card feed roller assembly having a sensing element adjacent a rotating element on a shaft.

FIG. 10 shows a perspective view of an embodiment for sensor and magnet positioning on a rotating element to assist in jam detection. FIG. 10, which except for numbering is identical to FIG. 8, shows a perspective view of an embodiment for sensor and magnet positioning on a rotating element to assist in jam detection. A card-moving or card drive element 300 has a friction engaging roller 302 attached to a shaft 304. Attached to one end of the shaft 304 is a plate 306. On the plate 306 are embedded magnets 308. Only one magnet 308 is shown because of the perspective of the figure and another magnet being obscured by frame 312. Supported on the frame 312 are two magnetic field detectors 310.

Although specific shuffling devices have been described and specific components, movements, processes and formats have been provided in the examples, it is clear that alternatives and equivalents can be used by the skilled artisan in practicing the technology described herein. All examples and suggestions are intended to support generic concepts and are not intended to limit practice of the technology unless specifically limited in the claims.

APPENDIX

PROGRAM OF OPERATION FOR SHUFFLING DEVICE

```
#include "blocka11.h"
//jam sensor
void program_init(void);
unsigned getAdc(unsigned char channel);
void delay10us(unsigned char delay);
```

APPENDIX-continued

PROGRAM OF OPERATION FOR SHUFFLING DEVICE

```
#pragma vector = 0x04                    //interrupt vector
_interrupt void Interrupt(void)
{if (INTE && INTF)
{INTF = OFF; if (!running)
    {running = ON;
    lastValue = BLOCKADE_VALUE-1;
// start value
    actValue = BLOCKADE_VALUE-1;}
  else
    {actValue = actTimeOut;}
    actTimeOut = 0;
    average = (lastValue + actValue) >> 1;
    runningTimeOut = average * 4;
    if (runningTimeOut > 0xFF)
// not more than 255*4ms = 1sek
    runningTimeOut = 0xFF;
    lastValue = actValue;}
  else
    {if (T0IE && T0IF)
    //timer0 interrupt every 4,096ms
    {T0IF = OFF; if (actTimeOut < CHAR_MAX)
    {actTimeOut++;}
    if (runningTimeOut)
      runningTimeOut--;
    if (timer0_counter)
      {timer0_counter--;}
  else
    {timer0_counter = TIMER_VALUE;
  //initiate Timer_counter --> cycle of 500ms}
    }}}
void main(void)
  {program_init( );
    while (1)
    {_clear_watchdog_timer( ); if (encoder2Status)
    {if (!ENCODER2)
      {encoder2Status = ENCODER2;if (!running)
      {running = ON;
      lastValue = BLOCKADE_VALUE-1;
    // start value
      actValue = BLOCKADE_VALUE-1;}
  else
    {actValue = actTimeOut;}
    actTimeOut = 0;
    average = (lastValue + actValue) >> 1;
    runningTimeOut = average * 4;
    if (runningTimeOut > 0xFF)
      // not more than 255*4ms = 1sek
      runningTimeOut = 0xFF;
      lastValue = actValue;}}
  else
    {if (ENCODER2)
      {encoder2Status = ENCODER2;}}
      if (running)
    {if (runningTimeOut)
    {if (!OUTPUT)
    {OUTPUT = ON; STATUS_LED = OFF;}
      if (average > BLOCKADE_VALUE)
    //motor is driving too slowly --> blockade
      {if (OUTPUT){OUTPUT = OFF; STATUS_LED = ON;
        running = OFF; }}}
else
    {if (OUTPUT){OUTPUT = OFF;
        STATUS_LED = ON;
        running = OFF;}}}
else
    {desiredTimeOut
    etAdc(ADC_CHANNEL_DESIRED_TIMEOUT);}}}
void program_init(void){_set_configuration_word(MCLRE_OFF &
CP_OFF &
PWRTE_ON & WDT_ON & INTRC_OSC_NOCLKOUT);
  OPTION = 0x83;
//weak pullup disabled, interrupt on falling edge of GP2 pin
  //timer0 clock internal, increment on low to high transition of GP2 pin
  //Prescaler = 1:16 for timer0 --> timeout of 4,096ms
    if (POR == 0)
  //POR has been occurred {// routine after power on
      POR = 1;}
      TRIS = TRIS_INIT;
```

APPENDIX-continued

PROGRAM OF OPERATION FOR SHUFFLING DEVICE

```
        //set I/O for Ports
        GPIO = PORT_INIT;
      //initiate output ports
        ADCON1 = 6;
      //GP0 is analog inputs
        ADCON0 = 0x41;
  //Conversion Clock = FOsc/8, channel 0 is selected, AD on
        timer0_counter = TIMER_VALUE;
  //initiate Timer_counter --> cycle of 500ms
        encoder2Status = ENCODER2;
        INTCON = 0xF0;
  //enable global, peripheral, timer0 and external (GP2) interrupt}
        unsigned getAdc(unsigned char channel)
        (adcSum = 0;
        adcCounter = 0;
        ADCON0 = 0x41 | channel;
  //select ad channel delay10us(2);
//start up adc module and channel change
        do
  {_clear_watchdog_timer( );
     GO = ON;
  //start new A/D conversation
        _ no_ operation( );
        while (GO);
  //A/D over ?
        adcValue = ADRES;
        adcSum += adcValue;
        adcCounter++;
        if (adcCounter == 1)
  //if 1st measurement, last value is actual measurement
     adcLastValue = adcValue;
     if ((abs(adcValue-adcLastValue)) > SAMPLEERROR_ADC)
     {//if last value is greater or higher SAMPLEERROR_ADC -> new
  measure
     adcSum = 0;
     adcCounter = 0;}
adcLastValue = adcValue;}
while (adcCounter < SAMPLES_ADC);
adcSum >>= SAMPLEDIVIDOR_ADC;
adcResult = (unsigned char)adcSum;
return adcResult;}
void delay 10us(unsigned char delay)
{unsigned char delay_counter1;
  for (delay_counter1=0; delay_counter1<delay; delay_counter1++)
{_clear_watchdog_timer( );
  _no_operation( );}
```

What is claimed is:

1. A shuffling device for randomizing playing cards, the device comprising:

components for contacting at least one playing card within the shuffling device to initiate or suspend movement of the at least one playing card;

a processor in informational connection with the shuffling device; and at least one sensor configured and positioned to detect, without reference to playing card movement or position, values of an operational parameter of one or more of the components consisting of at least one of speed of movement of, distance of movement of, time of movement of, power supplied for movement of, force applied to, and torque applied to the one or more components and to provide a signal to the processor representative of one or more values of at least one of speed of movement of, distance of movement of, time of movement of, power supplied for movement of, force applied to and torque applied to the one or more components by sensing a magnetic field characteristic of the one or more components;

the processor programmed to interpret the signal to recognize a departure in the operational parameter of the one or more components from one of an acceptable value and range of acceptable values.

2. The shuffling device of claim 1, wherein the processor is programmed to interpret a recognized departure in the operational parameter of the one or more components from one of an acceptable value and range of acceptable values as an indication that a defect in operation of the shuffling device has occurred.

3. The shuffling device of claim 1, wherein the processor is programmed to interpret a recognized departure in the operational parameter of the one or more components from one of an acceptable value and range of acceptable values as an indication of a playing card jam within the shuffling device.

4. The shuffling device of claim 3, wherein the processor is programmed to automatically reverse a direction of movement of at least one card in response to the indication of a jam.

5. The shuffling device of claim 1, wherein the one or more components comprise at least one of a shaft, a roller, a pusher, a grip, and an elevator.

6. The shuffling device of claim 2, wherein the one or more components comprise at least one of a shaft, a roller, a pusher, a grip, and an elevator.

7. The shuffling device of claim 3, wherein the one or more components comprise at least one of a shaft, a roller, a pusher, a grip, and an elevator.

8. The shuffling device of claim 2, wherein the shuffling device further comprises a carousel or fan having multiple compartments into which at least one card is randomly placed.

9. The shuffling device of claim 1, wherein the at least one sensor is selected from the group consisting of electronic sensors, electromechanical sensors, magnetic sensors, mechanical sensors and optical sensors.

10. The shuffling device of claim 3, wherein the shuffling device further comprises a carousel or fan having multiple compartments into which at least one card is randomly placed from a first group of cards.

11. The shuffling device of claim 2, wherein the shuffling device further comprises a carousel or fan having multiple compartments into which at least two cards are randomly placed, one at a time, from a first group of cards.

12. The shuffling device of claim 3, wherein the shuffling device further comprises a carousel or fan having multiple compartments into which at least two cards are randomly placed, one at a time, from a first group of cards.

13. The shuffling device of claim 2, wherein the shuffling device further comprises an elevator comprising a single card-mixing compartment into which one card at a time is randomly placed from a first group of cards into an increasing collection of cards in the mixing compartment.

14. The shuffling device of claim 3, wherein the shuffling device further comprises an elevator comprising a single card-mixing compartment into which one card at a time is randomly placed from a first group of cards into an increasing collection of cards in the mixing compartment.

15. The shuffling device of claim 2, wherein the shuffling device further comprises a stack of multiple compartments into which at least two cards are randomly placed, one at a time, from a first group of cards.

16. The shuffling device of claim 3, wherein the shuffling device further comprises a stack of multiple compartments into which at least two cards are randomly placed, one at a time, from a first group of cards.

17. The shuffling device of claim 1, wherein the shuffling device is configured to randomly eject playing cards out of a first set of cards, transport the randomly ejected cards to a card-receiving area, and collect the cards on the card-receiving area as a randomized set of cards.

18. The shuffling device of claim 1, wherein the shuffling device is configured to randomly insert cards from a first group of cards into an accumulating randomized set of cards by randomly separating the randomized set of cards into at least two segments and inserting one card at a time into a space between the two segments.

19. A method of detecting deficiencies in the operation of a playing card-shuffling device, the method comprising:

moving one or more components for contacting at least one playing card within the shuffling device to initiate or suspend movement of the at least one playing card; and detecting with at least one sensor, without reference to playing card movement or position, values of an operational parameter of the one or more of the components consisting of at least one of speed of movement of, distance of movement of, time of movement of, power supplied for movement of, force applied to, and torque applied to the one or more components and providing a signal to a processor representative of one or more values of at least one of speed of movement of, distance of movement of, time of movement of, force applied to and torque applied to the one or more components by sensing a magnetic field characteristic of the one or more components;

the processor interpreting the signal to recognize a departure in the operational parameter of the one or more components from one of an acceptable value and range of acceptable values.

20. The method of claim 19, wherein the processor interprets a recognized departure in the operational parameter of the one or more components from one of an acceptable value and range of acceptable values as an indication of a defect in operation of the shuffling device has occurred.

21. The method of claim 19, wherein the processor interprets a recognized departure in the operational parameter of the one or more components from one of an acceptable value and range of acceptable values as an indication of a playing card jam within the shuffling device.

22. The method of claim 19, wherein moving one or more components comprises moving at least one of a shaft, a roller, a pusher, a grip and an elevator.

23. The method of claim 20, wherein moving one or more components comprises moving at least one of a shaft, a roller, a pusher, a grip and an elevator.

24. The method of claim 21, wherein moving one or more components comprises moving at least one of a shaft, a roller, a pusher, a grip and an elevator.

25. The method of claim 19, further comprising detecting values of the operational parameter with the at least one sensor selected from the group consisting of electronic sensors, electromechanical sensors, magnetic sensors, mechanical sensors and optical sensors.

26. The method of claim 20, further comprising detecting values of the operational parameter with the at least one sensor selected from the group consisting of electronic sensors, electromechanical sensors, magnetic sensors, mechanical sensors and optical sensors.

27. The method of claim 21, further comprising detecting values of the operational parameter with the at least one sensor selected from the group consisting of electronic sensors, electromechanical sensors, magnetic sensors, mechanical sensors and optical sensors.

28. A playing card-shuffling device, comprising:

a card input portion for receiving cards to be shuffled;

a card-shuffling portion for receiving cards from the card input portion and outputting shuffled cards to a card outlet portion with at least one moving part of the shuffling device;

the card outlet portion being adapted for coupling to a first output card receiver when it is desired to remove shuffled cards one at a time from the shuffling device, and the card outlet portion being adapted for coupling to a second output card receiver when it is desired to remove a group of shuffled cards at a time from the shuffling device;

a processor in informational connection with the shuffling device; and at least one sensor configured and positioned to detect, without reference to playing card movement or position, values of an operational parameter of one or more of the components consisting of at least one of speed of movement of, distance of movement of, time of movement of, power supplied for movement of, force applied to, and torque applied to, the one or more components and to provide a signal to the processor representative of one or more values of at least one of speed of movement of, distance of movement of, time of movement of, power supplied for movement of, force applied to and torque applied to the one or more components by sensing a magnetic field characteristic of the one or more components;

the processor programmed to interpret the signal to recognize a departure in the operational parameter of the one or more components from one of an acceptable value and range of acceptable values.

29. The shuffling device of claim 28, wherein the card outlet portion comprises first alignment features for aligning with corresponding second alignment features on the first output card receiver and the second output card receiver.

30. The shuffling device of claim 28, wherein the processor is programmed to interpret a recognized departure in the operational parameter of the one or more components from one of an acceptable value and range of acceptable values as an indication of a defect in operation of the shuffling device has occurred.

31. The shuffling device of claim 28, wherein the processor is programmed to interpret a recognized departure in the operational parameter of the one or more components from one of an acceptable value and range of values as an indication that a playing card jam has occurred within the shuffling device.

32. The shuffling device of claim 28, wherein the one or more components comprise at least one of a shaft, a roller, a pusher, a grip, and an elevator.

33. The shuffling device of claim 30, wherein the one or more components comprise at least one of a shaft, a roller, a pusher, a grip, and an elevator.

34. The shuffling device of claim 31, wherein the one or more components comprise at least one of a shaft, a roller, a pusher, a grip, and an elevator.

35. The shuffling device of claim 28, wherein the shuffler further comprises a carousel or fan having multiple compartments into which at least one card is randomly placed from a first group of cards.

36. The shuffling device of claim 28, wherein the shuffler further comprises a carousel or fan having multiple compartments into which at least two cards are randomly placed, one at a time, from a first group of cards.

37. The shuffling device of claim 30, wherein the at least one sensor is selected from the group consisting of electronic sensors, electromechanical sensors, magnetic sensors, mechanical sensors and optical sensors.

38. The shuffling device of claim 31, wherein the at least one sensor is selected from the group consisting of electronic sensors, electromechanical sensors, magnetic sensors, mechanical sensors and optical sensors.

39. The shuffling device of claim 1, further comprising at least one component configured to initiate a signal indicative of at least the departure from the operational parameter to at least one of a display associated with the shuffling device and a distal location.

40. The shuffling device of claim 39, further comprising a processor programmed to analyze the signal to determine at least a potential cause of the departure from the operational parameter.

41. The method of claim 19, further comprising initiating a signal to at least one of display associated with the playing card-shuffling device and a distal location of at least the departure from the operational parameter.

42. The method of claim 41, further comprising analyzing the signal to determine at least a potential cause of the departure from the operational parameter.

43. The shuffling device of claim 28, further comprising at least one component configured to initiate a signal representative of at least the departure from the operational parameter to at least one of a display associated with the shuffling device and a distal location.

44. The shuffling device of claim 43, further comprising at least one of a microprocessor, system control board and central processing unit in communication with the shuffling device and programmed to analyze the signal to determine at least a potential cause of the departure from the operational parameter.

* * * * *